US007597125B2

(12) United States Patent
Deaton

(10) Patent No.: US 7,597,125 B2
(45) Date of Patent: Oct. 6, 2009

(54) FRESH DISPENSE CLEANING PRODUCT

(76) Inventor: Levi Deaton, 411 W. Ontario St., Suite 620, Chicago, IL (US) 60610

( * ) Notice: Subject to any disclaimer, the term of this patent is extended or adjusted under 35 U.S.C. 154(b) by 397 days.

(21) Appl. No.: 10/559,510

(22) PCT Filed: Sep. 28, 2004

(86) PCT No.: PCT/US2004/031755

§ 371 (c)(1),
(2), (4) Date: Dec. 5, 2005

(87) PCT Pub. No.: WO2005/032323

PCT Pub. Date: Apr. 14, 2005

(65) Prior Publication Data

US 2006/0151054 A1 Jul. 13, 2006

Related U.S. Application Data

(60) Provisional application No. 60/506,207, filed on Sep. 29, 2003.

(51) Int. Cl.
*B65B 1/04* (2006.01)
*A47J 47/18* (2006.01)

(52) U.S. Cl. ..... 141/364; 141/363; 141/375; 15/264

(58) Field of Classification Search ..... 141/2, 141/18, 67, 100–107, 192, 198, 231, 363–366, 141/375; 220/54, 500, 531; 15/260, 264; 4/626

See application file for complete search history.

(56) References Cited

U.S. PATENT DOCUMENTS

| | | | | |
|---|---|---|---|---|
| 1,354,240 | A * | 9/1920 | Buraky | 312/228 |
| 2,664,584 | A | 1/1954 | Twerdahl | |
| 3,045,252 | A | 7/1962 | Sorrells | |
| 3,630,369 | A | 12/1971 | Nichols | |
| 4,161,799 | A | 7/1979 | Sorrells | |
| 4,716,619 | A * | 1/1988 | Young | 15/262 |
| 4,798,307 | A | 1/1989 | Evrard | |
| 6,115,877 | A | 9/2000 | Morad et al. | |
| 6,253,394 | B1 * | 7/2001 | Goyette et al. | 4/626 |
| 6,260,230 | B1 | 7/2001 | Hunt | |
| 6,523,220 | B1 | 2/2003 | Lynn | |
| 2003/0037390 | A1 | 2/2003 | Leblanc | |

* cited by examiner

*Primary Examiner*—Timothy L Maust
(74) *Attorney, Agent, or Firm*—David J. Bremer

(57) ABSTRACT

The invention is a cleaning product for use with a cleaning applicator, such as a sponge mop, a squeegee, and various other applicators. The product provides an applicator bath holding a rinse fluid for rinsing the applicator. The product facilitates a range of cleanliness levels by discarding contaminated rinse fluid and replenishing the rinse fluid with clean fluid as often as the user requires, in order to meet the desired level of cleanliness.

20 Claims, 7 Drawing Sheets

FRESH DISPENSE CLEANING PRODUCT

The invention is a cleaning product for use with a cleaning applicator; for example a rag, a sponge, a string mop, a sponge mop, a squeegee, and various other applicators.

The product can be utilized in a cleaning process where a fluid is transferred to the applicator in order to facilitate cleaning an object with the applicator. In such a process, the applicator is rinsed in the fluid and then applied to the object to be cleaned. The applicator picks up dirt and other contaminants from the object and then the dirt, contaminants, and residual fluid are separated from the applicator and discarded. Finally, the applicator is rinsed in fresh fluid and the process is repeated.

The product maintains a volume of rinse fluid for transferring to the applicator. The rinse fluid can be substantially wholly discarded and then replenished with clean fluid whenever a user determines that the rinse fluid is sufficiently contaminated by prior contacts with the applicator. The rinse fluid is replenished from a reservoir of clean fluid.

The product provides superior flexibility by enabling the user to select an acceptable level of rinse fluid contamination, in accordance with the nature of the object being cleaned and the degree of cleanliness required. For example, cleaning floors in a hospital can require a more stringent degree of cleanliness than cleaning floors in a department store.

For more stringent cleanliness requirements, the rinse fluid can be discarded after each transfer of rinse fluid to the applicator. When the product is used in such a manner, the object to be cleaned is less likely to be re-contaminated by a dirty applicator.

When a lesser degree of cleanliness is required, the rinse fluid can be used to rinse the applicator more than one time.

The product can adapt to a range of different cleanliness requirements by enabling the user to discard and replenish the rinse fluid as needed.

The product can be utilized in various other processes where the process can benefit from the improved cleanliness and superior flexibility provided by the product.

The product has a waste receptacle for holding discarded fluid. The waste receptacle can have various sizes and shapes so long as the receptacle can hold fluid discarded from the applicator and from the applicator bath.

Figure 1:
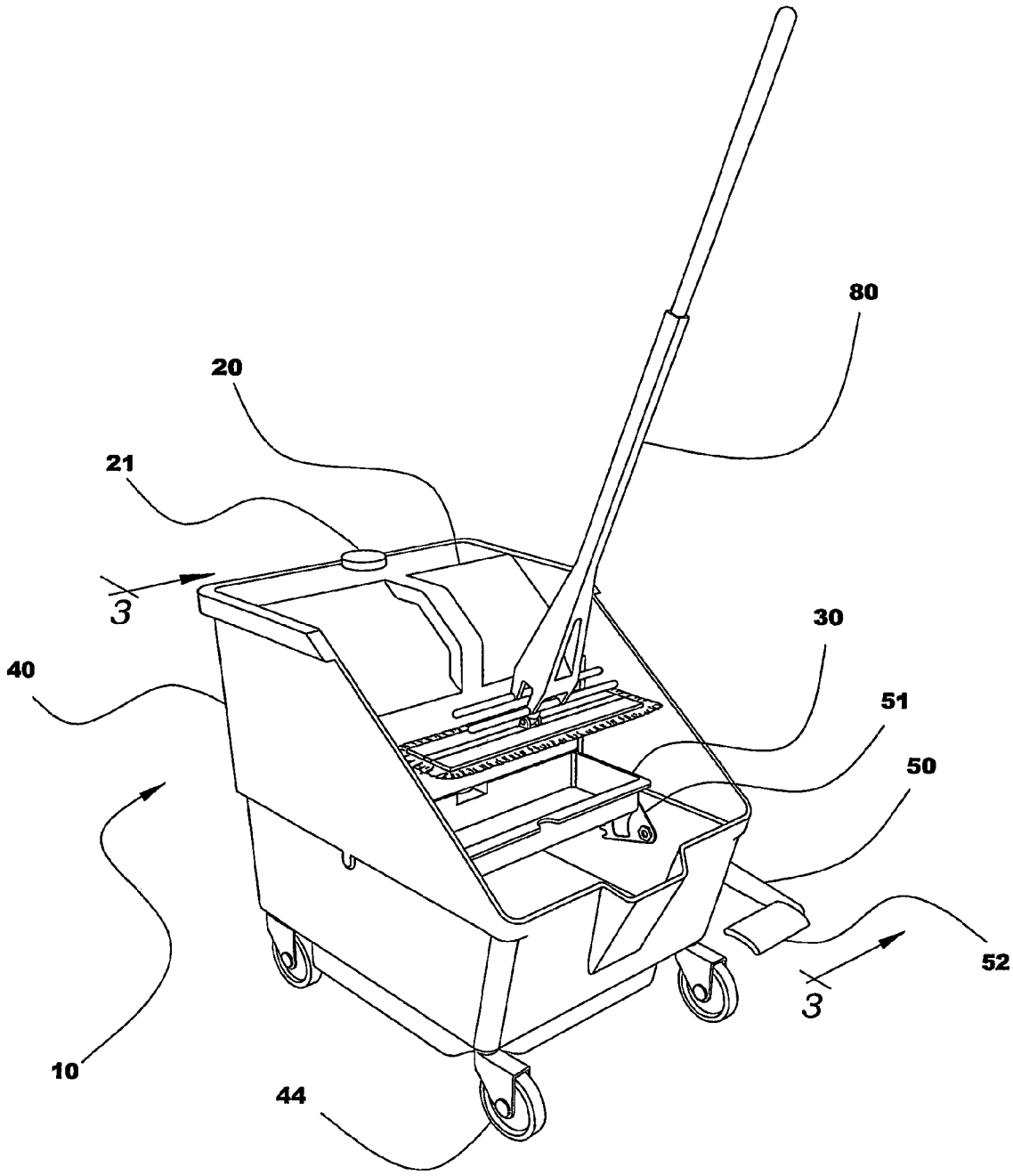
FIG. 1 is a perspective view of an embodiment of the product.
Figure 7:
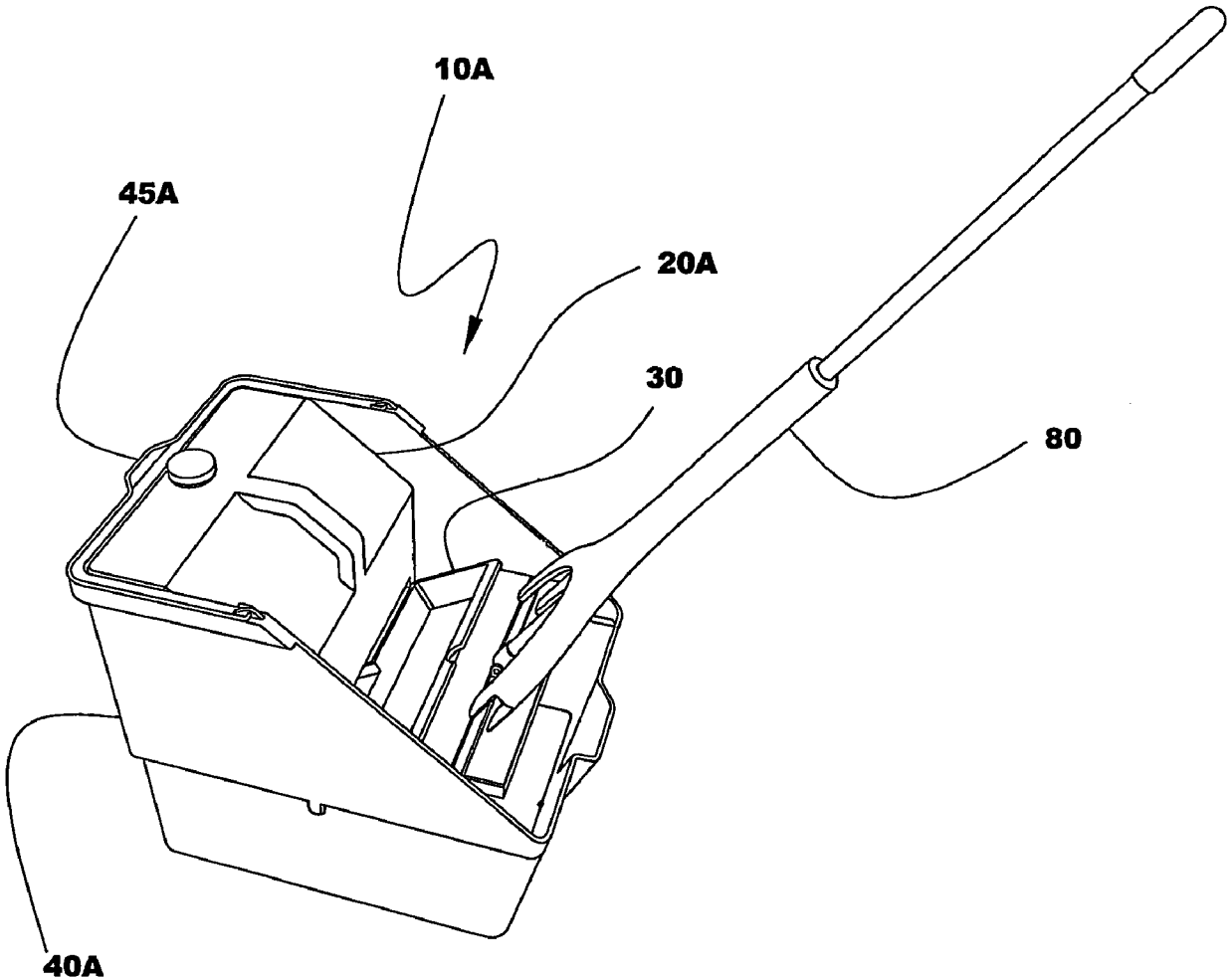
FIG. 7 is a perspective view of another embodiment of the product.
Figure 8:
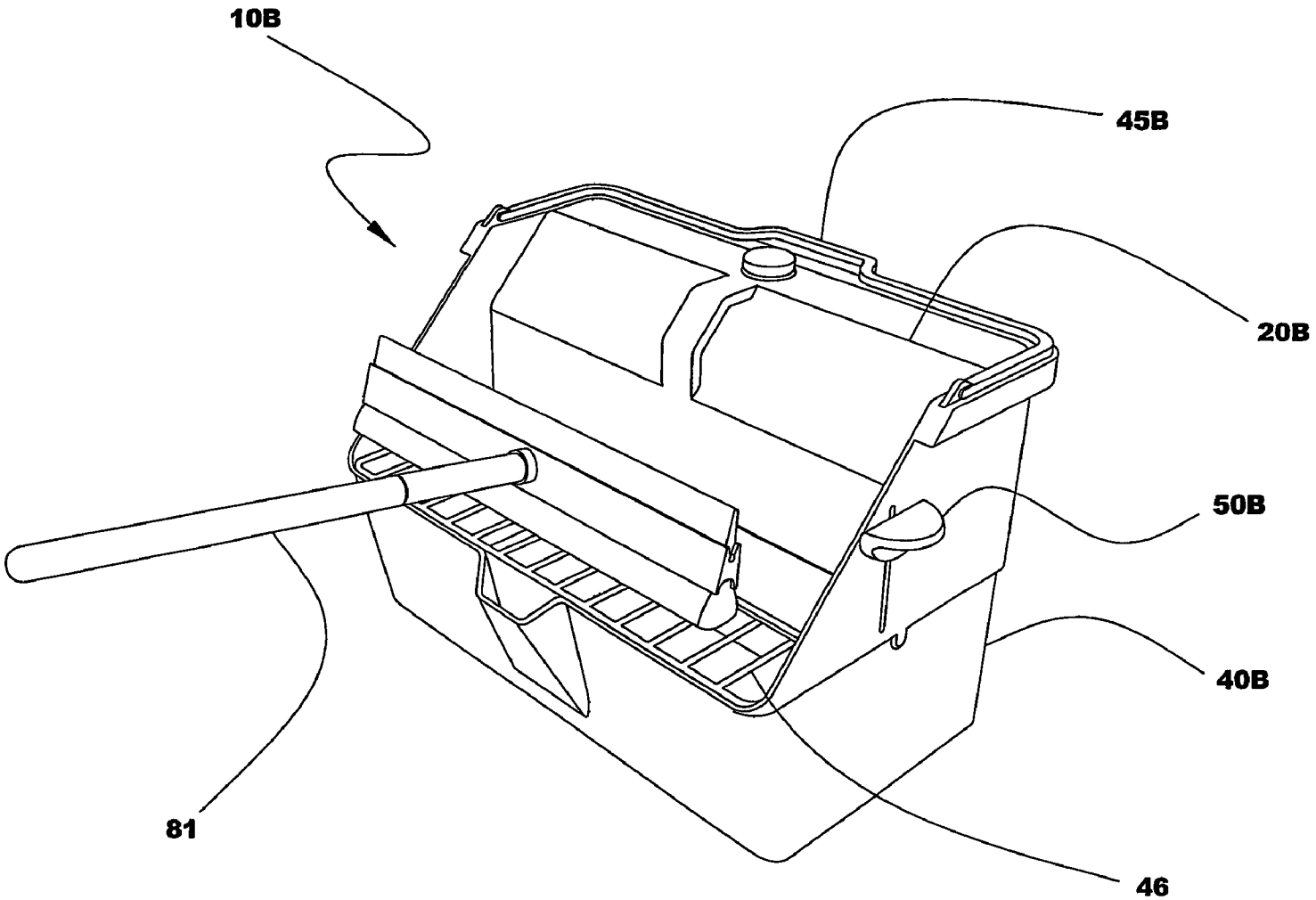
FIG. 8 is a perspective view of another embodiment of the product.

As shown in FIG. 1, FIG. 7, and FIG. 8, the waste receptacles 40, 40A, and 40B, respectively, are bucket-type receptacles with the upper portion of the bucket providing a support structure for other elements of the product.

In other embodiments, the waste receptacle can have various other forms, such as a bottle and other types of containers, so long as the receptacle can hold the discarded fluid until the receptacle is emptied.

The receptacle can have means for emptying the discarded fluid from the receptacle. For example, the receptacle can have a drain positioned to facilitate emptying the discarded fluid.

Alternatively, inverting the receptacle and allowing the discarded fluid to run out can empty the receptacle. Various other means and methods can be utilized for emptying the waste receptacle.

The waste receptacle can have wheels and casters for enhancing mobility. The receptacle 40 has casters, such as the caster 44.

The product has a reservoir for holding clean fluid. The reservoir is used to replenish the applicator bath with clean fluid.

The fluid can be water, soap, cleaning solvent, and various fluids and combinations thereof as may be preferred for the cleaning process.

The reservoir can be removable for easy filling, for example, filling from a faucet and from a hose.

As shown in FIG. 1, the product 10 has a reservoir 20. The reservoir 20 is a closed-top reservoir and closes via a cap 21. In other embodiments of the product, the reservoir can be an open-top reservoir.

Figure 2:
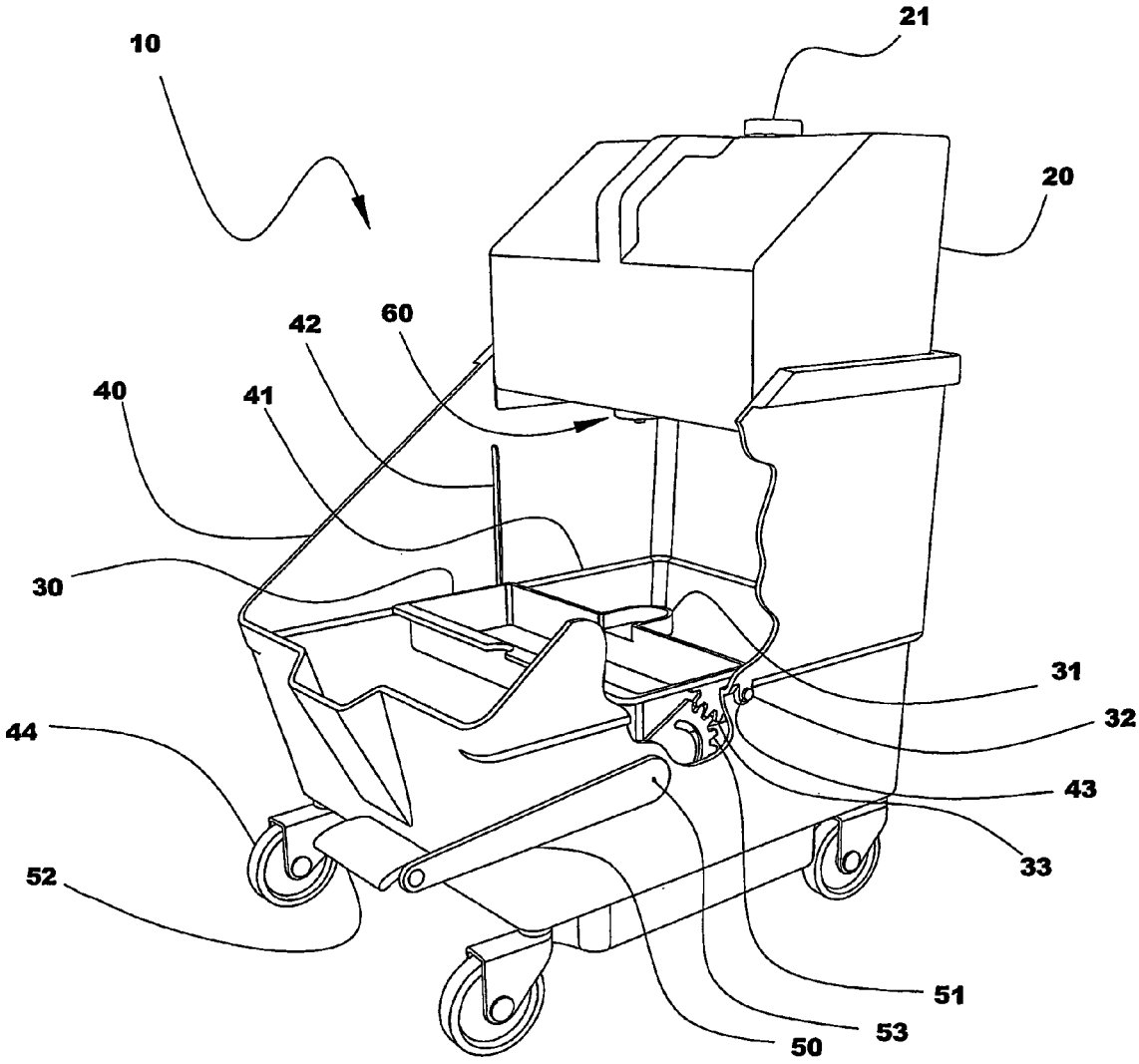
FIG. 2 is a perspective view of the product with the reservoir in a raised position.

As shown in FIG. 2, the receptacle 40 provides a mounting structure for the reservoir 20. The reservoir 20 fits substantially inside the receptacle 40. The reservoir 20 is positioned in the receptacle by a shelf 41 that can be formed into the receptacle. The reservoir 20 is further positioned in the receptacle by a rib 42 that can be formed into the receptacle.

In other embodiments of the product, the reservoir can be positioned outside of the receptacle and the reservoir can be spatially separated from the reservoir.

The reservoir can have a first reservoir component and a second reservoir component. The first reservoir component and the second reservoir component are functionally interchangeable with the reservoir.

For example, the reservoir can utilize a first reservoir component for holding soap and a second reservoir component for holding water.

The product has an applicator bath for holding a rinse fluid for transferring to the applicator by rinsing. The bath receives clean fluid from the reservoir and retains the fluid as rinse fluid for rinsing the applicator.

The bath has a fill mode and an empty mode. The bath is switchable between the fill mode and the empty mode.

The bath in use in the fill mode holds the rinse fluid for rinsing the applicator. The bath in use in the empty mode discards the rinse fluid to the waste receptacle.

The product 10 has an applicator bath 30 positioned within the receptacle 40 proximal the reservoir 20. An applicator, such as the sponge mop 80, can be rinsed with the rinse fluid in the bath 30.

The bath 30 is pivotally connected to the receptacle via pivot pins, such as the pivot pin 32. The pivot pins extend from the bath through receptacle pivot holes, such as the pivot hole 43. The bath 30 switches between the fill mode and the empty mode by rotating.

The bath 30 is positioned so as to discard the rinse fluid into the receptacle 40 when the bath is switched from the fill mode to the empty mode by rotating.

Figure 3B:
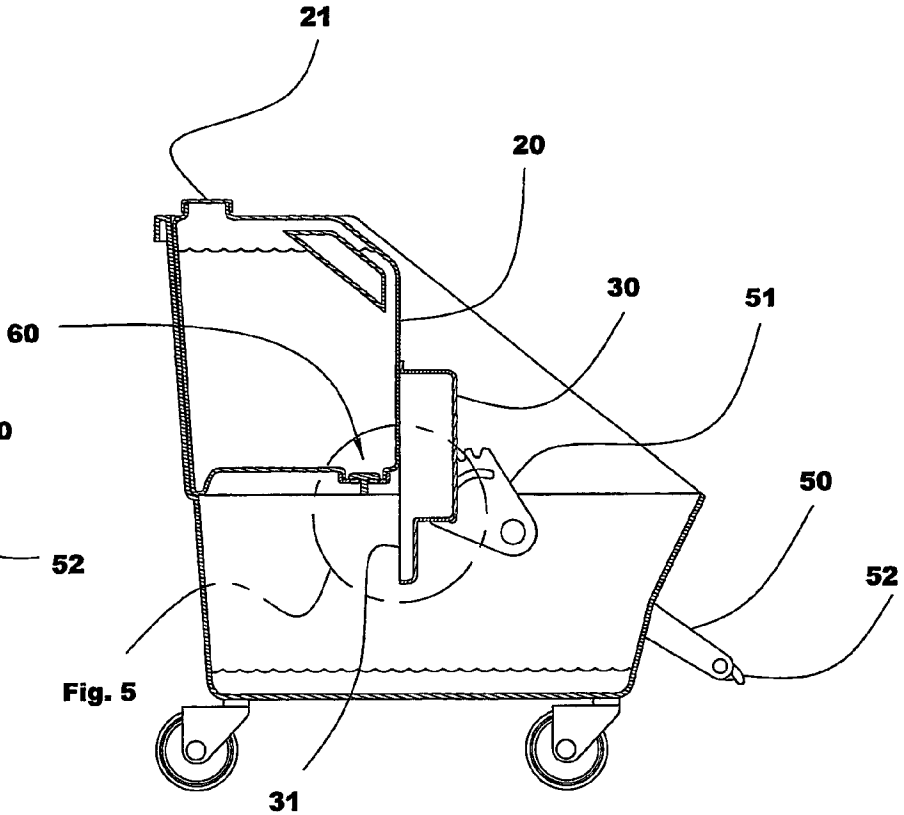
FIG. 3B is a section view showing the applicator bath in the empty mode.
Figure 3A:
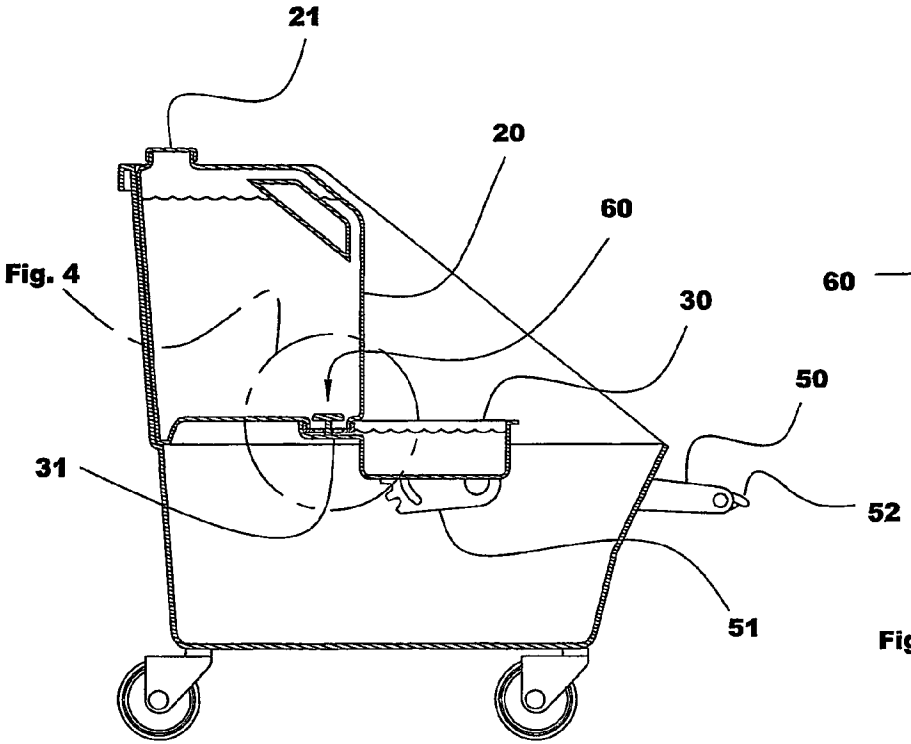
FIG. 3A is a section view across line 3-3 in FIG. 1 showing the applicator bath in the fill mode.

In FIG. 3A, the applicator bath 30 is shown in the fill mode.

In FIG. 3B, the bath 30 is shown after being rotated-to the empty mode.

In other embodiments the bath can be switched between the fill mode and the empty mode by various means.

For example, the bath can have a discharge valve that opens to enable fluid in the bath to discharge into the receptacle.

Alternatively, the bath can utilize a grid panel that can alternate between a non-porous position and a porous position to switch between the fill mode and the empty mode, respectively.

Various other means for discarding the rinse fluid from the bath can be utilized so long as the bath holds the rinse fluid when in use in the fill mode and discards the rinse fluid to the receptacle when in use in the empty mode.

The product can have an actuator for switching the bath between the fill mode and the empty mode. The actuator can be a manual actuator; for example a hand-operable actuator and a foot-operable actuator.

The product 10 has a foot-lever actuator 50. The actuator 50 comprises a pedal 52 rotatably connected to the receptacle 40 via an actuator shaft 53. The shaft 53 is fixed to an actuator gear 51. The shaft 53 and the actuator gear 51 rotate as one about the shaft 53.

The actuator gear 51 engages a bath gear 33. The bath gear 33 is fixed to the bath 30. The bath 30 and the bath gear 33 rotate as one.

When the actuator 50 is rotated; for example by depressing the pedal 52, the interacting actuator gear 51 and bath gear 33 cause the bath 30 to switch between the fill mode and the empty mode.

FIG. 3A shows the product 10 with the bath 30 in the fill mode holding the rinse fluid.

FIG. 3B shows the product 10 with the foot-lever actuator 50 depressed and the bath 30 rotated to the empty mode, the bath having discarded the rinse fluid into the receptacle 40.

Various actuators can be utilized for switching the bath. Mechanical linkages, springs, cables, pulleys, electrical actuators such as solenoids and motors, magnetic actuators, pneumatic, hydraulic, and various other actuators can all be utilized. In FIG. 8, the product 10B has an actuator 50B that can be operated by hand and operated by foot.

Alternatively, the actuator can be an automatic actuator. The automatic actuator can be adapted to switch the bath at predetermined intervals, for example after each transfer of fluid to the applicator and after a predetermined number of transfers.

Alternatively, the bath can have no actuator. When no actuator is present, the bath can be switched by hand and by utilizing at least a part of the applicator to switch the bath. In FIG. 7, the bath 30 is shown being rotated to the empty mode by utilizing the sponge mop 80.

The product has a fluid dispenser for dispensing clean fluid from the reservoir to the bath. The dispenser is fluid-wise connected to the bath.

The dispenser controls the transfer of clean fluid from the reservoir to the bath and facilitates replenishing the rinse fluid when the rinse fluid level in the bath falls below a predetermined level. The dispenser can be manually activated by the user.

Alternatively, the dispenser can be an automatic dispenser that automatically dispenses the clean fluid to the bath when a rinse fluid level in the bath falls below a predetermined range. For example, when the rinse fluid in the bath is discarded to the waste receptacle, the rinse fluid level in the bath falls below the predetermined range and the dispenser can automatically dispense the clean fluid from the reservoir into the bath until the rinse fluid level reaches the predetermined range.

Similarly, after fluid is transferred from the bath to the applicator, the rinse fluid level in the bath can fall below the predetermined range. When it does, the dispenser can automatically dispense clean fluid into the bath until the rinse fluid level reaches the predetermined range.

As shown in FIG. 2, the product 10 has an automatic dispenser 60 positioned at a lower portion of the reservoir 20.

Figure 4:
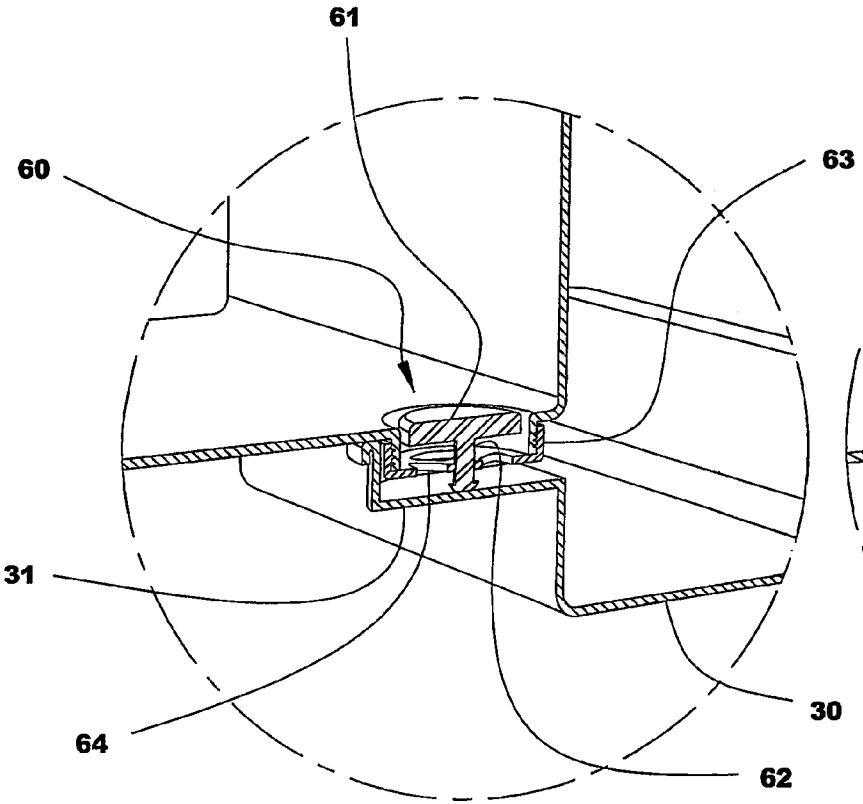
FIG. 4 is a scaled section view showing the fluid dispenser with the applicator bath in the fill mode.

In FIG. 4, the dispenser 60 is shown in use with the bath in the fill mode. The dispenser 60 has a valve 61 positioned within a valve seat 63. The valve 61 has a stem 62 extending from the valve through the seat.

With the bath in the fill mode, a bath collector 31 contacts the valve stem 62 and raises the valve 61 above the seat 63 thus exposing a drain hole 64 in the seat. When the drain hole 64 is exposed, the clean fluid dispenses from the reservoir to the bath 30.

Figure 5:
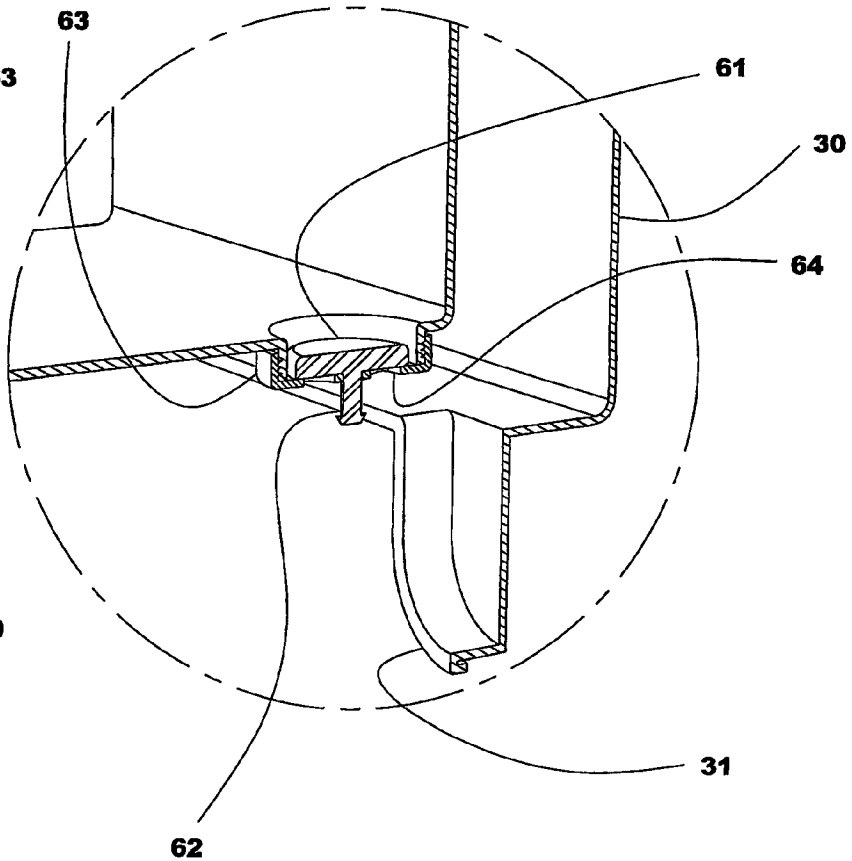
FIG. 5 is a scaled section view showing the fluid dispenser with the applicator bath in the empty mode.

In FIG. 5, the dispenser 60 is shown in use with the bath in the empty mode. When the bath 30 switches to the empty mode, the bath collector 31 moves away from the valve stem 62. The valve 61 drops into contact with the seat 63 to block the drain hole 64 and to stop the clean fluid from dispensing to the bath 30.

The dispenser 60 functions most effectively with a closed-top reservoir, such as the reservoir 20. With the bath in the fill mode and the drain hole exposed by the valve, the clean fluid automatically dispenses from the dispenser until the rinse fluid level reaches the drain hole. When the rinse fluid level reaches the drain hole, the reservoir is unable to draw air through the drain hole and the clean fluid stops flowing from the reservoir through the dispenser into the bath.

Other types of dispensers can function effectively with open-top reservoirs. For example, a float-activated dispenser can effectively dispense clean fluid from the reservoir to the bath as needed to maintain the rinse fluid level within a predetermined range.

Alternatively, some types of dispensers can function effectively with both open-top and closed-top reservoirs.

Alternatively, the dispenser can be moisture-activated, temperature-activated, and have various other methods and combinations thereof for dispensing fluid so long as the dispenser can dispense the clean fluid to the bath when the fluid level falls below a predetermined range.

Alternatively, the dispenser can be manually activated.

The dispenser can have a first dispenser component and a second dispenser component. The first dispenser component and the second dispenser component are functionally interchangeable with the dispenser.

For example, the first dispenser component can be connected to the first reservoir component and dispense fluid from the first reservoir component. Similarly, the second dispenser component can be connected to the second reservoir component and dispense fluid from the second reservoir component.

The dispenser can have a mixer for combining fluid dispensed from the first dispenser component with fluid dispensed from the second dispenser component. The mixer can be adjustable to separately control the dispensing of fluid from the first dispenser component and the dispensing of fluid from the second dispenser component.

Alternatively, the dispenser can have a mixer for combining air and other gasses with the fluid dispensed from the reservoir.

The dispenser 60 is positioned at the reservoir 20 and dispenses fluid directly to the bath 30. Other embodiments of the product can have the dispenser spatially separated from the reservoir. For example, the dispenser can be distal the reservoir and fluid-wise connected to the reservoir via a tube, a pipe, and by various other open and closed conduits.

Similarly, the dispenser can be distal the bath and fluid-wise connected to the bath via a tube, a pipe, and by various other open and closed conduits.

The dispenser can have a barrier for isolating the clean fluid in the reservoir from the rinse fluid in the bath when the clean fluid is not dispensing to the bath. A barrier can prevent diffusion and backwash of rinse fluid, from the bath into the reservoir, that could contaminate the clean fluid in the reservoir.

Figures 6A, 6B, 6C:
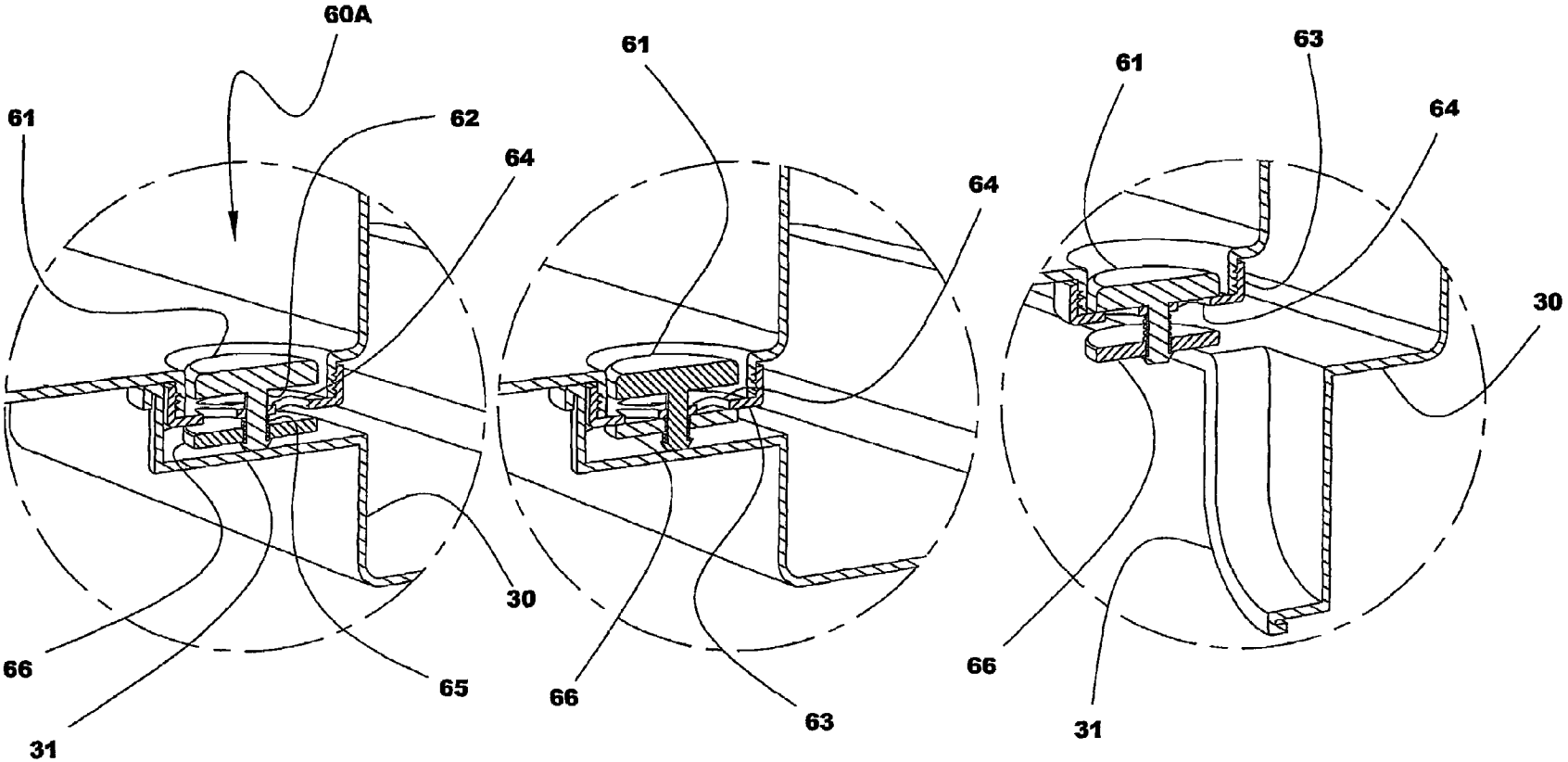
FIG. 6A is a scaled section view showing the barrier fluid dispenser with the applicator bath in the fill mode and the barrier open.
FIG. 6B is a scaled section view showing the barrier fluid dispenser with the applicator bath in the fill mode and the barrier closed.
FIG. 6C is a scaled section view showing the barrier fluid dispenser with the applicator bath in the empty mode.

FIG. 6A, FIG. 6B, and FIG. 6C, show a dispenser 60A that has a barrier. In the dispenser 60A the barrier is a buoyant disk 66 that encircles the valve stem 62 and a return spring 65 biasing the valve towards the seat. The return spring is not required for the barrier function. The return spring is not required for the function of the valve. The rinse fluid is not shown in FIG. 6A, FIG. 6B, and FIG. 6C.

In FIG. 6A, the dispenser 60A is shown with the bath 30 in the fill mode and the rinse fluid level below the predetermined range. In FIG. 6A, the collector 31 has moved the valve 61 away from the drain hole 64, enabling the clean fluid to dispense from the reservoir to the bath. The buoyant disk 66 is positioned distal the valve 61.

In FIG. 6B, the rinse fluid level has reached the predetermined range and the buoyant disk 66 has risen with the fluid level until the buoyant disk 66 is contacting the valve seat 63 and the buoyant disk 66 is blocking the drain hole 64.

By blocking the drain hole, the buoyant disk prevents the rinse fluid in the bath from contaminating the clean fluid in the reservoir.

The barrier of dispenser 60A function most effectively with a closed-top reservoir.

Other types of dispensers can have barriers that can function effectively with open-top reservoirs.

Alternatively, some types of dispensers can have barriers that can function effectively with both open-top and closed-top reservoirs.

Various types of barriers can be utilized to isolate the reservoir from the applicator bath. For example, some float-activated dispensers can provide barriers for both open-top reservoirs and closed top reservoirs. Various other dispensers that inherently provide barriers are well-known in the art FIG. 7 and FIG. 8 each show a different embodiment of the product.

As shown in FIG. 7, the product 10A can be used for household cleaning. The receptacle 40A does not have casters and can be somewhat smaller than the receptacle 40. The receptacle 40A has a handle 45A to facilitate moving the product. The reservoir 20A is removable for filling and emptying.

The product 10A does not have an actuator for switching the bath between the fill mode and the empty mode. As shown in FIG. 7, the bath 30 can be switched by hand and by using the applicator, for example the sponge mop 80.

As shown in FIG. 8, the product 10B can be used for window cleaning. The receptacle 40B has a handle 45B to facilitate moving the product. The reservoir 20B is removable for filling and for emptying.

The product 10B has an actuator 50B for switching the bath between the fill mode and the empty mode. The actuator 50B can be foot-operable and hand-operable.

The receptacle 40B has a receptacle grid 46 to facilitate removing residual fluid from the applicator, such as the squeegee 81.

Other embodiments can utilize various means for removing residual fluid from the applicator. For example, the product 10 can have a wringer connected to the receptacle to facilitate removing fluid from a string mop-type applicator.

I claim:

1. A cleaning product for use with a cleaning applicator such as a rag, a sponge, a string mop, a sponge mop, a squeegee, and various other applicators, the product comprising:

a waste receptacle for holding a discarded fluid separated from the applicator;

a fluid reservoir for holding a clean fluid;

an applicator bath for holding a rinse fluid for transferring to the applicator by rinsing, the bath having a fill mode and an empty mode;

the bath in use in the fill mode holding the rinse fluid for rinsing the applicator;

the bath in use in the empty mode discarding the rinse fluid to the waste receptacle;

the bath being switchable between the fill mode and the empty mode as needed to control contamination of the rinse fluid;

a fluid dispenser for dispensing the clean fluid from the reservoir to the bath;

the dispenser being fluid-wise connected to the reservoir;

the dispenser in use dispensing the clean fluid from the reservoir to the bath as needed to maintain the rinse fluid in the bath within a predetermined volumetric range; and the product, in use being configured so that the fluid separated from the applicator can be discarded directly to the waste receptacle without passing the fluid through the applicator bath and without disconnecting the reservoir from the dispenser.

2. The cleaning product of claim 1 wherein the fluid dispenser further comprises a barrier for isolating the clean fluid in the reservoir from the rinse fluid in the bath when the clean fluid is not dispensing to the bath.

3. The cleaning product of claim 1 further comprising:

an actuator for switching the applicator bath between the fill mode and the empty mode.

4. The cleaning product of claim 1 wherein the applicator bath switches between the fill mode and the empty mode by rotating.

5. The cleaning product of claim 1 wherein the fluid reservoir in use is positioned above the waste receptacle and the applicator bath in use is positioned between the fluid reservoir and the waste receptacle.

6. The cleaning product of claim 5 wherein the waste receptacle in use supports the fluid reservoir and the applicator bath.

7. The cleaning product of claim 6 wherein the applicator bath is pivotally connected to the waste receptacle and wherein the applicator bath switches between the fill mode and the empty mode by rotating.

8. The cleaning product of claim 3 wherein the actuator is foot-operable.

9. The cleaning product of claim 3 wherein the actuator is hand-operable.

10. The cleaning product of claim 1 wherein the reservoir is a closed-top reservoir.

11. A cleaning product for use with a cleaning applicator such as a rag, a sponge, a string mop, a sponge mop, a squeegee, and various other applicators, the product comprising:

a waste receptacle for holding a discarded fluid separated from the applicator;

a fluid reservoir for holding a clean fluid;

an applicator bath for holding a rinse fluid for transferring to the applicator by rinsing, the bath having a fill mode and an empty mode;

the bath in use in the fill mode holding the rinse fluid for rinsing the applicator;

the bath in use in the empty mode discarding the rinse fluid to the waste receptacle;

the bath being switchable between the fill mode and the empty mode as needed to control contamination of the rinse fluid;

a fluid dispenser being fluid-wise connected to the reservoir;

the fluid dispenser comprising:

a valve, the valve in use sensing when the applicator bath is in the fill mode;

the valve in use sensing when the applicator bath is in the empty mode;

the valve in use when the applicator bath is in the fill mode causing the fluid dispenser to dispense clean fluid to the applicator bath as needed to maintain the rinse fluid in the applicator bath within a predetermined volumetric range;

the valve in use when the applicator bath is in the empty mode causing the fluid dispenser to stop dispensing fluid to the applicator bath; and the product in use being configured so that the fluid separated from the applicator can be discarded directly to the waste receptacle without passing through the applicator bath.

12. The cleaning product of claim 11 wherein the fluid dispenser further comprises a barrier for isolating the clean fluid in the reservoir from the rinse fluid in the bath when the clean fluid is not dispensing to the bath.

13. The cleaning product of claim 11 further comprising an actuator for switching the applicator bath between the fill mode and the empty mode.

14. The cleaning product of claim 11 wherein the applicator bath switches between the fill mode and the empty mode by rotating.

15. The cleaning product of claim 11 wherein the fluid reservoir in use is positioned above the waste receptacle and the applicator bath in use is positioned between the fluid reservoir and the waste receptacle.

16. The cleaning product of claim 15 wherein the waste receptacle in use supports the fluid reservoir and the applicator bath.

17. The cleaning product of claim 15 wherein the applicator bath is pivotally connected to the waste receptacle and wherein the applicator bath switches between the fill mode and the empty mode by rotating.

18. The cleaning product of claim 13 wherein the actuator is foot-operable.

19. The cleaning product of claim 13 wherein the actuator is hand-operable.

20. The cleaning product of claim 11 wherein the reservoir is a closed-top reservoir.

* * * * *